US011273636B2

(12) United States Patent
Johnson et al.

(10) Patent No.: US 11,273,636 B2
(45) Date of Patent: Mar. 15, 2022

(54) ADAPTIVE PRINTHEAD CLEANING

(71) Applicants: Scott R. Johnson, Erie, CO (US); William Edward Manchester, Erie, CO (US); Constantino J. Tadiello, Fort Collins, CO (US); Nathan Young, Boulder, CO (US)

(72) Inventors: Scott R. Johnson, Erie, CO (US); William Edward Manchester, Erie, CO (US); Constantino J. Tadiello, Fort Collins, CO (US); Nathan Young, Boulder, CO (US)

(73) Assignee: Ricoh Company, Ltd., Tokyo (JP)

( * ) Notice: Subject to any disclaimer, the term of this patent is extended or adjusted under 35 U.S.C. 154(b) by 7 days.

(21) Appl. No.: 16/711,751

(22) Filed: Dec. 12, 2019

(65) Prior Publication Data

US 2021/0178752 A1 Jun. 17, 2021

(51) Int. Cl.
*B41J 2/045* (2006.01)

(52) U.S. Cl.
CPC ..... *B41J 2/0451* (2013.01); *B41J 2/04536* (2013.01); *B41J 2/04586* (2013.01)

(58) Field of Classification Search
CPC ... B41J 2/0451; B41J 2/04536; B41J 2/04586
See application file for complete search history.

(56) References Cited

U.S. PATENT DOCUMENTS 6,293,645 B1 9/2001 Kim
6,652,064 B2 * 11/2003 Bruch ..... B41J 2/0451 347/19
7,380,899 B2 6/2008 Arakawa et al.
7,775,626 B2 8/2010 Taga et al.
8,070,253 B2 12/2011 Kuroda et al.
8,733,877 B2 5/2014 Inoue
9,539,803 B2 1/2017 Michel et al.
(Continued)

FOREIGN PATENT DOCUMENTS

JP 2003089226 A 3/2003
JP 2019101540 A 6/2019

OTHER PUBLICATIONS

Felix Boumann et al; Vision based error detection for 3D printing processes; University of Stuttgart; MATEC Web of Conferences 59, 06003 (2016).

(Continued)

*Primary Examiner* — Thinh H Nguyen
(74) *Attorney, Agent, or Firm* — Duft & Bornsen, PC

(57) ABSTRACT

Systems and methods are provided for adaptive printhead cleaning. One embodiment is a printer maintenance system that includes memory to store defect information of a group of nozzles of a printer, and a processor to determine whether the group of nozzles have a number of nozzle defects that exceeds a threshold based on the defect information. In response to a determination that the threshold is exceeded, the processor determines a type of cleaning operation, a cleaning duration, and a cleaning intensity to perform for the group of nozzles based on the defect information. The processor then initiates a cleaning operation for the group of nozzles according to the type of cleaning operation, the cleaning duration, and the cleaning intensity determined for the group of nozzles.

20 Claims, 5 Drawing Sheets

(56) References Cited

U.S. PATENT DOCUMENTS

| | | | | |
|---|---|---|---|---|
| 9,681,006 | B2 | 6/2017 | Tanabe | |
| 10,404,868 | B2 | 9/2019 | Spivakovsky et al. | |
| 2004/0246294 | A1* | 12/2004 | Mitsuzawa ..... | B41J 2/16579 347/23 |

OTHER PUBLICATIONS

Larry Willoughby; Machine vision system makes light of high-speed printing inspection.

* cited by examiner

ADAPTIVE PRINTHEAD CLEANING

TECHNICAL FIELD

The invention relates to the field of printing, and in particular, to cleaning printheads of a printer.

BACKGROUND

An inkjet production printer is a high-speed printer used for volume printing (e.g., one hundred pages per minute or more), and may include continuous-forms printers that print on a web of print media stored on a large roll. While a continuous-forms inkjet printer operates, the web is quickly passed underneath the nozzles of printheads of the printer, which discharge ink onto the web at intervals to form pixels.

Although most of the ink dispensed by the printheads is transferred to the web, some amount of ink remains on the nozzles of the printheads. Over time, congealed ink, contaminants, or nozzle structural failures may form which clogs or partially clogs nozzles, resulting in defective ink jets that degrades print quality. A production printer may therefore be equipped with an automatic maintenance system that periodically cleans the printheads.

Cleaning operations are costly to perform since it involves halting printing for an extended period of time and can involve flushing expensive ink to clear the nozzles. Printer manufacturers therefore continue to seek techniques that strike an improved balance between cleaning printheads frequently enough to eliminate print defects while minimizing maintenance costs.

SUMMARY

Embodiments herein describe adaptive printhead cleaning. A maintenance system of a printer automatically determines the next cleaning action to perform taking into account nozzle-level jet defect information and variable threshold levels that depend on user preference for acceptable print quality. Additionally, the maintenance system determines whether jetting defects are persistent so as to avoid wasting ink/time in cleaning defects that are unrecoverable. The maintenance system is thus able to determine an optimal cleaning sequence and type/intensity of cleaning that recovers defects in a manner that adapts to a number of variables while minimizing the number of maintenance operations, wasted ink, and operator judgement thereby reducing maintenance costs.

One embodiment is a system that includes a printer maintenance system including memory to store defect information of a group of nozzles of a printer, and a processor configured to determine whether the group of nozzles have a number of nozzle defects that exceeds a threshold based on the defect information. In response to a determination that the threshold is exceeded, the processor is configured to determine a type of cleaning operation, a cleaning duration, and a cleaning intensity to perform for the group of nozzles based on the defect information. The processor is further configured to initiate a cleaning operation for the group of nozzles according to the type of cleaning operation, the cleaning duration, and the cleaning intensity determined for the group of nozzles.

Another embodiment is a method of determining a category of cleaning to perform on nozzles of a printer. The method includes receiving defect information of a group of nozzles of the printer, and determining whether the group of nozzles have a number of nozzle defects that exceeds a threshold based on the defect information. The method further includes, in response to determining the threshold is exceeded, determining a type of cleaning operation, a cleaning duration, and a cleaning intensity to perform for the group of nozzles based on the defect information, and initiating a cleaning operation for the group of nozzles according to the type of cleaning operation, the cleaning duration, and the cleaning intensity determined for the group of nozzles.

Other illustrative embodiments (e.g., methods and computer-readable media relating to the foregoing embodiments) may be described below.

DESCRIPTION OF THE DRAWINGS

Some embodiments of the present invention are now described, by way of example only, and with reference to the accompanying drawings. The same reference number represents the same element or the same type of element on all drawings.

DETAILED DESCRIPTION

The figures and the following description illustrate specific illustrative embodiments. It will thus be appreciated that those skilled in the art will be able to devise various arrangements that, although not explicitly described or shown herein, embody the principles of the embodiments and are included within the scope of the embodiments. Furthermore, any examples described herein are intended to aid in understanding the principles of the embodiments, and are to be construed as being without limitation to such specifically recited examples and conditions. As a result, the inventive concept(s) is not limited to the specific embodiments or examples described below, but by the claims and their equivalents.

Figure 1:
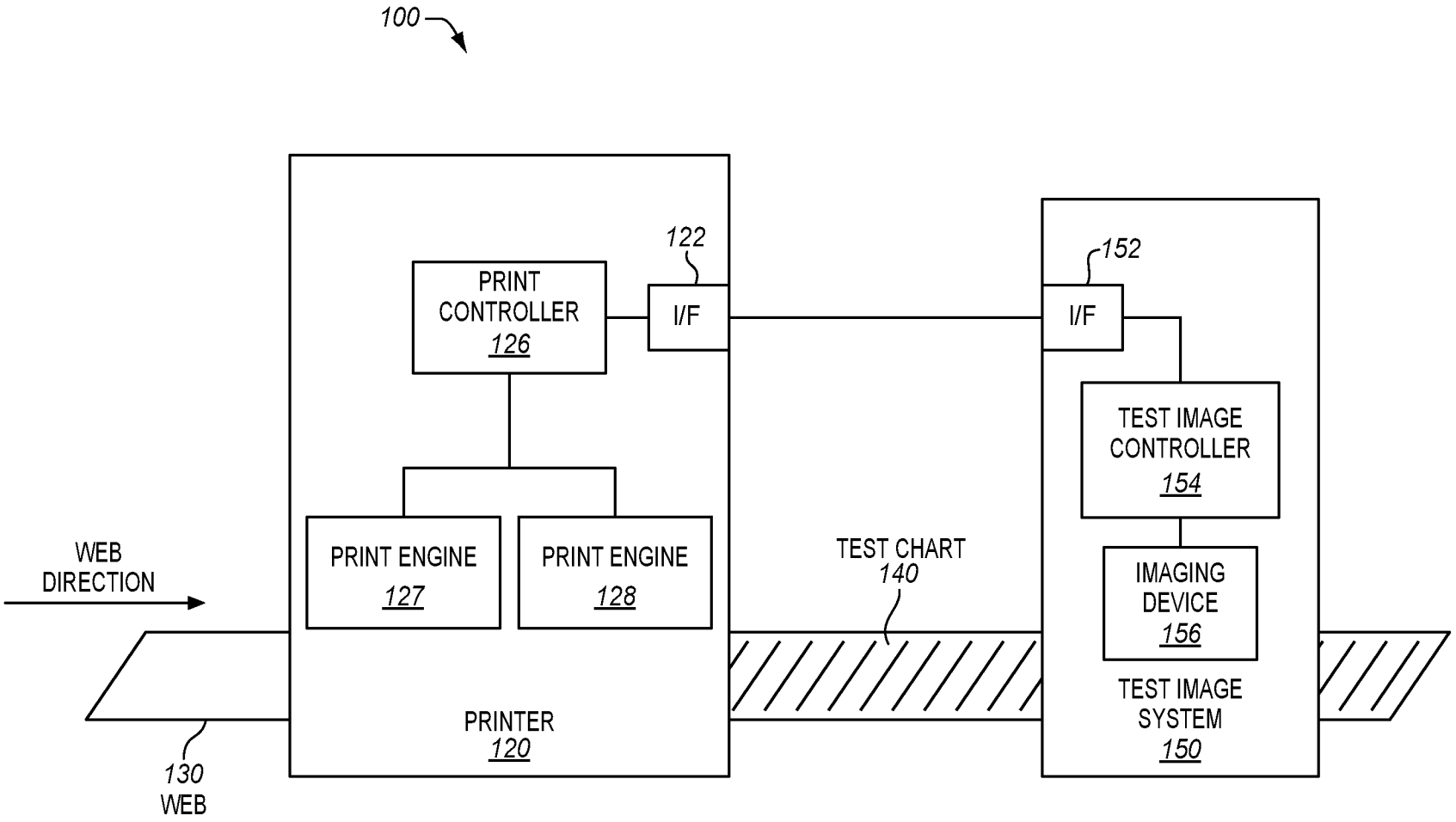
FIG. 1 is a diagram of a printing system in an illustrative embodiment.

FIG. 1 is a diagram of a print system 100 in an illustrative embodiment. The print system 100 includes a printer 120 and a test image system 150. Under normal printing operation, the printer 120 receives a print job, generates rasterized print data for the print job with the print controller 126, and transmits the rasterized print data for the print job to one or more print engines 127-128. The print engines 127-128 mark the web 130 of print media (e.g., paper, textile, printable substrate) with ink (e.g., marking material, colorant, etc.) according to the rasterized print data, thus producing printed output.

Occasionally, to verify that the print engines 127-128 are operating correctly, the print controller 126 instructs the print engines 127-128 to print a test chart 140 based on test chart print data onto web 130 that can be analyzed manually or by a test image system 150 for print defects. The test image system 150 includes an interface 152, a test image controller 154, and one or more imaging device(s) 156. The imaging device 156 may comprise a camera, scanner, densitometer, spectrophotometer or other suitable component for acquiring images of printed content. Test chart 140 may be printed on the web 130 separately from the print jobs or with the print jobs (e.g. on sections of the web 130 separate from the sections of the web 130 printed with the print jobs).

After obtaining an image of the test chart 140 via the imaging device 156, the test image controller 154 analyzes the image for jet defects. For example, the test image controller 154 may be configured to determine which particular printheads or nozzles printed the defects based on the location of the defect in the test chart 140. The test image system 150 and printer 120 may communicate via interfaces 122/152 (e.g., an Ethernet interface, wireless interface, etc.). For instance, the print controller 126 may transmit a rasterized version of the print data corresponding to test chart 140 to the test image system 150 for comparison to an image of the test chart 140 to determine whether there are any discrepancies that indicate printing errors, and the test image system 150 may report print defect data back to the printer 120 to inform maintenance procedures.

Current print systems often simply perform printer maintenance functions on a fixed periodic schedule, with interruptions to the schedule occurring every time a print defect is found in a periodically printed test chart 140. However, it is often the case that it is unnecessary to perform a cleaning operation so frequently. For example, a user or customer of the printer 120 may desire to avoid the cost and time expense of performing maintenance procedure to fix a small number of print defects as the print quality standards for their purposes may tolerate a larger number of print defects. In another example, some print defects may reoccur even after a maintenance procedure was performed in attempt to fix the print defect, and it may be a waste to perform the same maintenance procedure again to fix this reoccurring defect.

Figure 2:
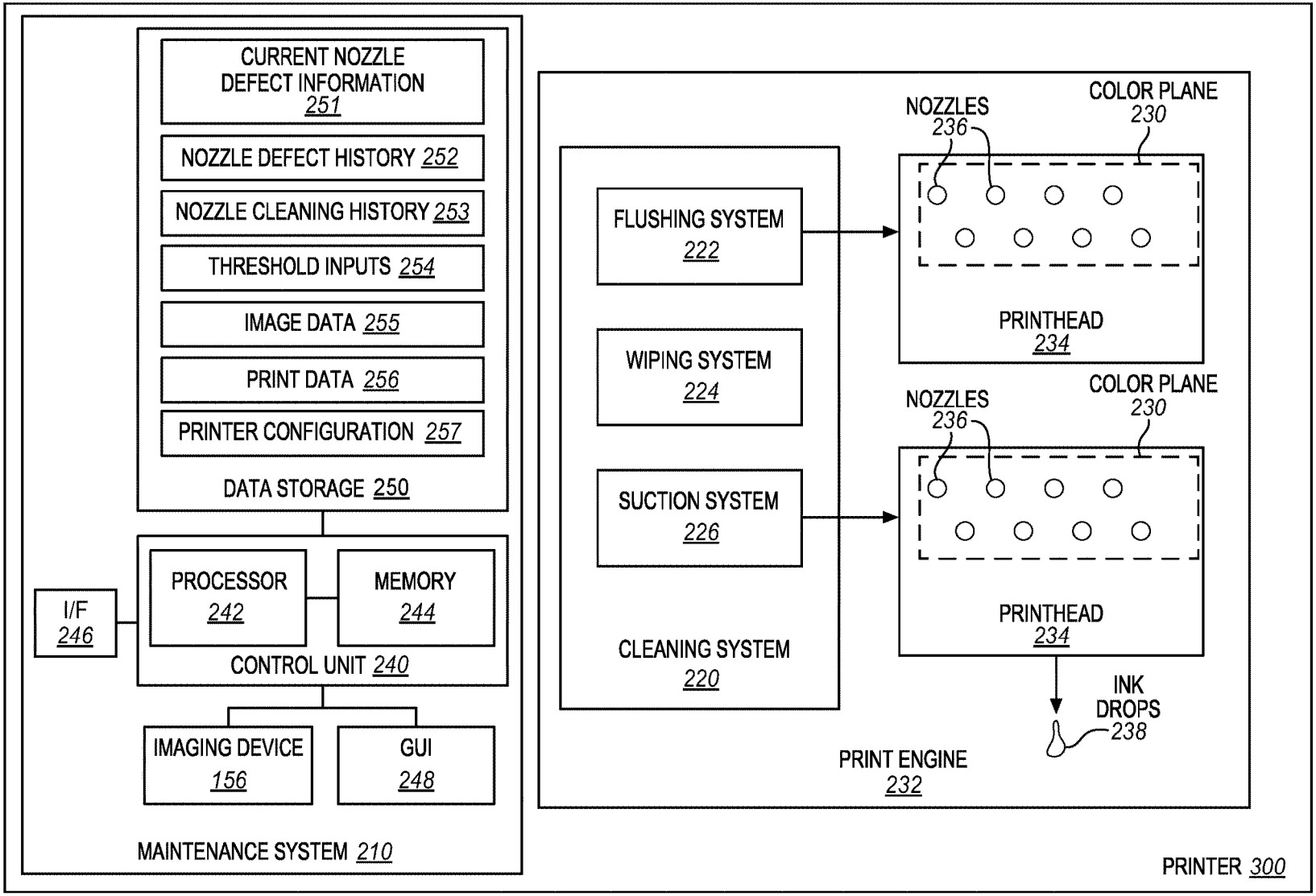
FIG. 2 is a block diagram of a printer in an illustrative embodiment.

FIG. 2 is a block diagram of a printer 200 in an illustrative embodiment. The printer 200 includes a maintenance system 210 that addresses the above-described issues. The maintenance system 210 directs a cleaning system 220 including one or more of a flushing system 222, a wiping system 224, and a suction system 226, to perform cleaning operations on printheads 234 of the printer 200. In particular, as described in further detail below, the maintenance system 210 is configured to perform adaptive printhead cleaning that repairs print defects to adhere to variable print quality thresholds while minimizing the number of maintenance operations.

The printer 200 generally includes a plurality of color planes 230 (e.g., cyan, magenta, yellow, and black) and print engines 232. Each print engine 232 may process print data for one or a plurality of color planes 230 and control one or a plurality of printheads 234 based on the print data. Each printhead 234 includes an array of nozzles 236 that eject drops of ink 238 for printing. The nozzles 236 of each printhead 234 may be assigned to one color plane or divided between a plurality of color planes 230. The printheads 236 may be configured physically in the web direction and/or orthogonal to the web direction. As earlier described, in the course of normal printing operation one or more of the nozzles 236 may clog with ink, resulting in print defects.

The maintenance system 210 is enhanced with a control unit 240 to adaptively determine cleaning instructions (e.g., operation type, cleaning intensity, cleaning duration, and/or cleaning timing) for transmittal to the cleaning system 220. The cleaning system 220 receives the cleaning instructions and executes them. In doing so, the control unit 240 may take into account variables stored in data storage 250, including any combination of current nozzle defect information 251, nozzle defect history 252, nozzle cleaning history 253, and threshold inputs 254. The data storage 250 may also store image data 255 of the test chart 140 captured by the imaging device 156 and/or print data 256 of the test chart 140. The data storage 250 may also store printer configuration 257 that may comprise information that correlates print locations, nozzles 236, printheads 234, print engines 232, color planes 230, and/or ink types (e.g. ink sets or specific ink colors). Additionally, the control unit 240 may be communicatively coupled with an interface 246 and/or a graphical user interface 248 for receiving user input and/or displaying notifications to the user of the printer 200.

While the specific hardware implementation of the control unit 240 is subject to design choices, one particular embodiment may include one or more processors 242 coupled with a memory 244. The processor 242 includes any electronic circuits and/or optical circuits that are able to perform functions. For example, a processor may include one or more Central Processing Units (CPU), Graphics Processing Unit (GPU), microprocessors, Digital Signal Processors (DSPs), Application-Specific Integrated Circuits (ASICs), Programmable Logic Devices (PLD), control circuitry, etc. Some examples of processors include Intel Core processors, Advanced Reduced Instruction Set Computing (RISC) Machines (ARM) processors, etc. The memory 244 includes any hardware device that is able to store data. The memory 244 may include one or more volatile or non-volatile Dynamic Random Access Memory (DRAM) devices, FLASH devices, volatile or non-volatile Static RAM devices, hard drives, Solid State Disks (SSDs), etc. Some examples of non-volatile DRAM and SRAM include battery-backed DRAM and battery-backed SRAM. The data storage 250 may similarly be implemented by any combination of memory devices or components.

The particular arrangement, number, and configuration of components described with respect to FIG. 2 is an example for purposes of discussion and are non-limiting. For example, though the maintenance system 210 is shown as incorporated in the printer 200, portions of the maintenance system 210 and functions performed thereby may be implemented in a separate system such as nearby in a control unit 240 (e.g. Digital Front End (DFE)) of the printer 200 or remotely as a standalone system (e.g., cloud implementation) in communication with the printer 200. Illustrative details of the operation of the maintenance system 210 will be discussed with regard to FIGS. 3-4.

Figure 3:
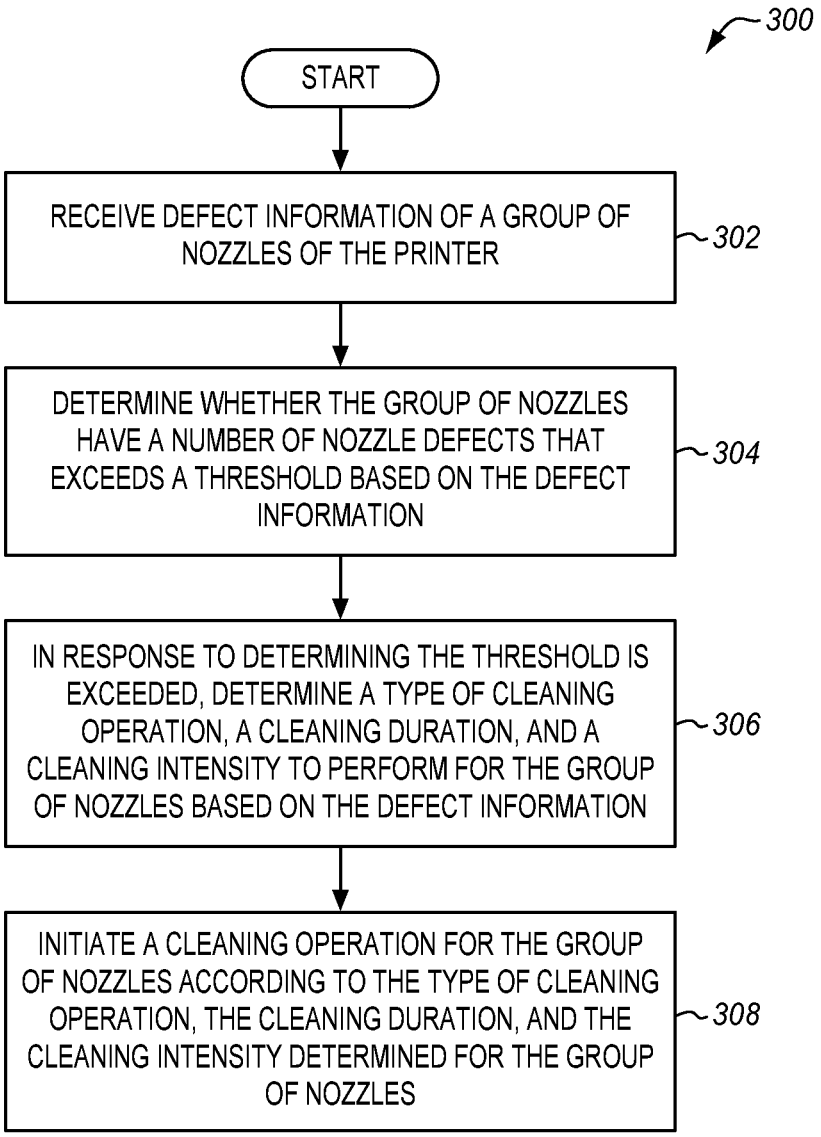
FIG. 3 is a flowchart illustrating a method of determining a category of cleaning to perform on nozzles of a printer in an illustrative embodiment.

FIG. 3 is a flowchart illustrating a method 300 of determining a category of cleaning to perform on nozzles of a printer in an illustrative embodiment. The steps of method 300 are described with reference to the printer 200 and maintenance system 210 of FIG. 2, but those skilled in the art will appreciate that method 300 may be performed in other systems. The steps of the flowcharts described herein are not all inclusive and may include other steps not shown. The steps described herein may also be optionally performed or performed in an alternative order.

In step 302, the control unit 240 receives defect information of a group of nozzles 236 of the printer 200. In doing so, the control unit 240 may analyze image data 255 of a test chart 140 and store current nozzle defect information 251 in data storage 250. The group of nozzles 236 may include a plurality of adjacent nozzles, the nozzles of one or more printheads 234, the nozzles of a print engine 232, nozzles corresponding to an ink 238 type/color, nozzles corresponding to a sub-system of a cleaning mechanism 220, nozzles corresponding to a print region on web 130 and/or the nozzles of a color plane 230. Thus, there may be several different types and sizes of nozzle groups for which defect analysis is performed.

The control unit 240 may correlate locations within the test chart 140 or image data 255 with individual nozzles 236 that printed a defect based on information of the printer configuration 257 stored in memory. Moreover, the control unit 240 may analyze the image data 255 to determine a type of nozzle defect based on the type of unexpected printed shape produced by an incorrectly jetted ink drop on the test chart 140. Types of nozzle defects may include a jet-out (caused due to complete blocking of a nozzle), a deviated jet (caused by a partial blocking of a nozzle), damaged nozzle plate (e.g., a delaminated nozzle plate or printhead caused by film on the printhead array peeling off from wear and tear), and unknown (other causes). The defect information may thus include an indication of which nozzles are defective, a type of nozzle defect of each defective nozzle, and/or when the defect occurred. Alternatively, the defect information may be received by maintenance system 210 (e.g. through interface 246) and stored in current nozzle defect information 251.

In step 304, the control unit 240 determines whether the group of nozzles have a number of nozzle defects that exceeds a threshold based on the defect information. Different thresholds may be set for different groups nozzles 236 and/or nozzle defects. For example, a threshold may indicate no more than two adjacent nozzles can print defects and/or no more than five nozzles within a single printhead can print defects. For example, two or more different nozzle defects may have differing thresholds. The threshold settings may be input by an operator and stored in data storage 250 or may be determined based on threshold inputs 254 as further described below.

In step 306, in response to determining the threshold is exceeded, the control unit 240 determines a type of cleaning operation, a cleaning duration, and a cleaning intensity to perform for the group of nozzles based on the defect information. The type of cleaning operation may be selected from any combination of a flushing operation performed by the flushing system 222, a wiping operation performed by the wiping system 224, and/or a suction operation performed by the suction system 226. Moreover, each type of cleaning operation may include several levels of intensity and/or a range of durations. The calculated cleaning parameters may thus indicate, for example, a flushing waveform for the flushing system 222, a pump time for the suction system 226, and/or an operational setting (e.g. a capping time, number of cycles) for the wiping system 224.

The control unit 240 is thus configured to adaptively determine the type and parameters of a cleaning operation (e.g., cleaning instructions) to perform based on the defect information indicating the number/type of nozzle defects (e.g., jet-outs, deviated jets, and damaged printhead errors) present in the nozzle group. As described in greater detail below, in further embodiments, the control unit 240 may determine the type and parameters of printhead cleaning based on the number of times the same nozzle defects have reoccurred, the number of cleaning operations previously performed in attempt to correct the nozzle defects, and/or the type and parameters of those previous cleaning operations. Cleaning instructions may be determined with look up tables, programmed logic, and/or trained machine learning processors. For example, different cleaning instructions would be determined for each of the defect types that comprise jet-outs, deviated jets, and damaged/delaminated printheads.

In step 308, the control unit 240 initiates a cleaning operation for the group of nozzles according to the type of cleaning operation, the cleaning duration, and the cleaning intensity determined for the group of nozzles. The control unit 240 may determine which printhead(s) 234 correspond with the group of nozzles, and direct the cleaning system 220 to perform a specific cleaning operation that adapts to the defect information received in step 302. The method 300 thus provides a benefit over prior techniques by performing a particular category of cleaning that adapts to the defect information rather than simply performing a predetermined cleaning routine each time a defective nozzle is detected.

Figure 4:
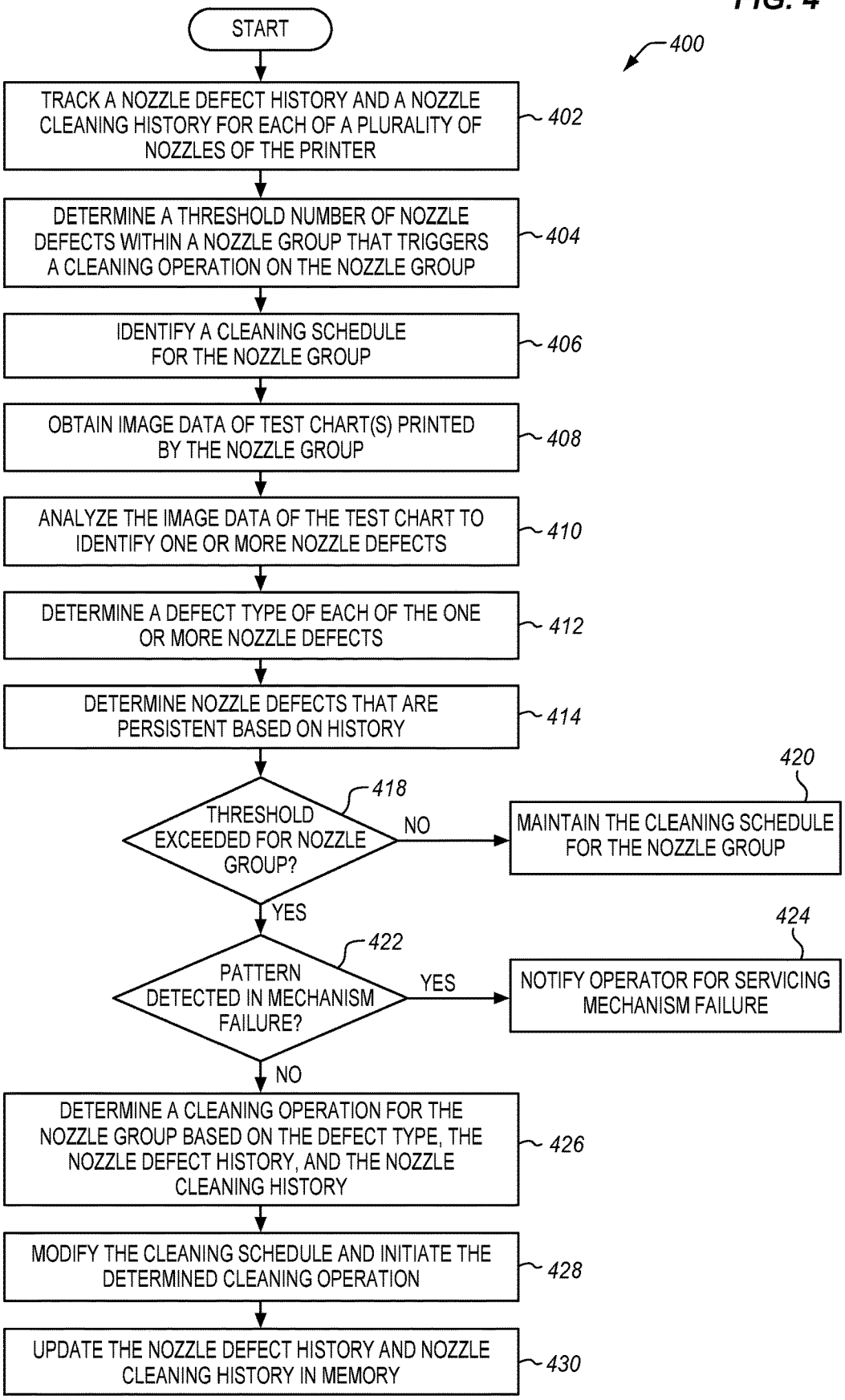
FIG. 4 is a flowchart illustrating a method of determining a category of cleaning to perform on nozzles of a printer in another illustrative embodiment.

FIG. 4 is a flowchart illustrating a method 400 of determining a category of cleaning to perform on nozzles of a printer in another illustrative embodiment. The steps of method 400 are described with reference to the printer 200 and maintenance system 210 of FIG. 2, but those skilled in the art will appreciate that method 400 may be performed in other systems. The steps of the flowcharts described herein are not all inclusive and may include other steps not shown. The steps described herein may also be optionally performed or performed in an alternative order.

In step 402, the control unit 240 tracks a nozzle defect history 252 and a nozzle cleaning history 253 for each of a plurality of nozzles 236 of the printer 200. For instance, test charts may be occasionally or periodically printed between normal print jobs to locate defective nozzles. The control unit 240 may store a log of the defects in data storage 250 as well as data indicating whether any cleaning operation was performed in attempt to correct the defective nozzle. The control unit 240 may additionally track the defect type, the cleaning operation type, cleaning intensity, the cleaning duration, and the time since a cleaning operation last completed in attempt to correct the defective nozzle. Furthermore, the control unit 240 may track whether any subsequent test chart analysis verified that the print defect was recovered by the cleaning operation. In other words, the control unit 240 may track the number of iterations the same nozzle jetted the same type of defect.

In step 404, the control unit 240 determines a threshold number of nozzle defects within a nozzle group that triggers a cleaning operation on the nozzle group. The control unit 240 may calculate multiple thresholds each indicating a maximum allowable number of defects for a different print region, defect type, and/or nozzle group, within the printer 200. For example, the control unit 240 may determine an engine threshold, a color plane threshold, an adjacent nozzle threshold, a dual head threshold, and/or a single head threshold. The nozzle group may thus correspond with a number of printheads 234 that share a common region within the printer 200.

In some embodiments, the threshold number of nozzle defects is based on an acceptable print quality level input by a user (e.g., no defects, minimal defects, few defects, or some defects). For example, based on the acceptable print quality level, the control unit 240 may calculate defect thresholds that vary by color plane 230, print engine 232, and/or printhead 234. The control unit 240 may calculate the thresholds for the differently sized nozzle groups using nozzle geometry between printheads 234, the number of printheads 234, and/or any unused nozzles.

The threshold number of nozzle defects may also vary on the web location. For example, the control unit 240 may calculate a threshold for nozzle groups that are determined to correspond with a printed text region or a printed image region in response to detecting a particular type of print job. This allows, for example, areas of the web that are less important for maintaining print quality (e.g., gutters) to be treated with more tolerance by assigning corresponding nozzles relatively higher thresholds. In another example, a job with primarily text filler can be adjusted with a higher threshold compared to a job with high quality images. The threshold number of nozzle defects may also be varied based on the color plane 230, ink type/color associated with the nozzle 236 and/or the printhead 234 type.

In step 406, the control unit 240 identifies a cleaning schedule for the nozzle group. The cleaning schedule may indicate an amount of elapsed time, ink use, or distance of printed material since a cleaning operation was last completed that triggers a new cleaning operation. If the cleaning schedule indicates that the printheads 234 are overdue for a cleaning operation then it may be automatically initiated at the next printer stopping point (e.g., end of print job, changing of web rolls, etc.). The cleaning schedule may indicate a sequence, timing, type, intensity, and duration of a cleaning operation or series of cleaning operations.

In some embodiments, the control unit 240 determines the initial cleaning schedule based on the model of the printer and/or the type of ink being used. For example, the first four cleaning operations for a first ink type may be set to a normal, all printhead cleaning operation followed by three intense, targeted printhead cleaning operations, with no maximum intensity cleaning operation. In another example, if a second ink type is used, the first four cleaning operations may be set to a normal, targeted printhead cleaning operation, an intense, targeted printhead cleaning operation, an intense, all printhead cleaning operation, and a maximum intensity, targeted printhead cleaning operation. Alternatively or additionally, the control unit 240 may obtain user input or system settings indicating a maximum number of cleaning operations to perform. For example, a particular nozzle group may be set to be cleaned no more than four times in a period of time.

In step 408, the control unit 240 obtains image data 255 of one or more test charts 140 printed by the nozzle group. In step 410, the control unit 240 analyzes the image data 255 of the test chart 140 and the print data 256 to identify one or more nozzle defects. And, in step 412, the control unit 240 determines a defect type of each of the one or more nozzle defects based on the shape of the defect. Thus, each time a test chart is printed, the control unit 240 calculates the defect for each nozzle 236 as well as their type of defect. The test chart 140 printed by the nozzle group may include more than one copy of a specific pattern, and the control unit 240 may analyze the print data 256 and combine information from multiple copies to determine the type of defects. Thus, the control unit 240 may obtain multiple test charts 140 and merge them to filter out recovered defects or defects that may not be accurately predicted. The control unit 240 may use a weighting function that treats the most recently printed defects as more important to the final determination of nozzle defects than that of earlier printed defects.

In step 414, the control unit 240 determines nozzle defects that are persistent based on the nozzle defect history 252 and the nozzle cleaning history 253. The determination of whether a nozzle defect is persistent may be based on the type of defect, the number of cleans performed in attempt to correct the defect, the type of cleans performed in attempt to correct the defect, and/or the elapsed time since the defect occurred. For example, the control unit 240 may analyze a group of image data 255 for previous printed test charts 140 (e.g., three to ten of the most recent previous test charts) to compare to the image data 255 for the current printed test chart 140. In another example, the control unit 240 may analyze corresponding nozzle defect history 252 and/or nozzle cleaning history 253 in comparison with corresponding current nozzle defect information 251 (e.g., using statistical analysis). The control unit 240 may calculate a persistency score based on the recency (e.g., time from the historical data) and the frequency of occurrence (sometimes referred to as frecency) to determine whether the defect is persistent. Persistency determination may also vary based on the type of defect. For example, jet-outs that recur for four to five cleans may be determined persistent, whereas deviated jets that recur three to four cleans may be determined persistent, and damaged/delaminated head errors that recur two to three times may be determined persistent. Thus, the control unit 240 may determine that the nozzle defects are persistent based on a number of previous cleaning operations that failed to correct a particular nozzle defect.

In step 418, the control unit 240 determines whether the threshold number of nozzle defects for the nozzle group is exceeded as a result of the one or more nozzle defects detected in the test chart 140. The determination of whether a threshold is exceeded may be based on counts of persistent defects and counts of non-persistent defects determined in step 414. For example, in one embodiment, the control unit 240 excludes the persistent nozzle defects from the nozzle defects detected for the nozzle group. In other words, persistent nozzle defects are prevented from being counted toward the threshold number of nozzle defects for the nozzle group, and persistent nozzle defects are not factored into the determination of whether the nozzle defect threshold is exceeded. Advantageously, cleaning operations may be avoided in situations in which a number of nozzle defects are persistent and therefore unlikely to be resolved by further cleanings.

If, in step 418, the threshold is not exceeded for the nozzle group, the method 400 proceeds to step 420 and the control unit 240 maintains the cleaning schedule and directs the cleaning system 220 to perform cleaning operations according to the cleaning schedule. Thus, even if the threshold is not exceeded, the control unit 240 may initiate a cleaning operation if the cleaning schedule (set in step 406) dictates as such according to a predetermined timing, cleaning sequence, printer conditions, etc. In one embodiment, if the number of total defects for the group (persistent and non-persistent) are below a given threshold, the control unit 240 may designate the nozzle group as exempt from cleaning or modifications to its scheduled cleanings. In another embodiment, if the number of persistent defects for the group is above a particular threshold (e.g., another threshold different than a total threshold), the control unit 240 may designate the nozzle group as failed, and exempt them from cleaning, regardless of the number of non-persistent defects, since defects are unlikely to be resolved by further cleanings. In yet another embodiment, if the number of total defects is above the threshold but the number of persistent defects is below its threshold, the control unit 240 may proceed to cleaning determination/initiation.

If the threshold is exceeded, the method 400 may proceed to step 422 and the control unit 240 determines whether a pattern is detected indicating a mechanism failure (e.g., printhead or cleaning system failure). For example, the control unit 240 may perform a pattern matching analysis on current and/or past defects to determine if a particular group of nozzles 236 are affected by a common issue such as a malfunctioning driver board, wiper, or capping station that is contributing to an increased rate of print defects for those nozzles they interact with. If such a pattern is detected, the method 400 proceeds to step 424 and the control unit 240 generates a message (e.g., for display on GUI 248) that notifies an operator for servicing the mechanism failure. For example, from analysis of defect information, the control unit 240 may detect a pattern that a nozzle group being wiped by a particular wiper includes a number/type/pattern of nozzle defects that indicate that wiper to be serviced/replaced and generate a message including that notification. Or, the control unit 240 may determine that a group of nozzles belonging to a particular printhead include defects that indicate a mechanical malfunction of the printhead, and may generate a message indicating to the operator to replace that printhead.

In step 426, the control unit 240 determines a type of cleaning operation, a cleaning duration, and a cleaning intensity to perform for the group of nozzles based on the defect type (e.g. the current nozzle defect information), nozzle defect history 252 and the nozzle cleaning history 253 of the nozzle group. Then, in step 428, the control unit 240 modifies the cleaning schedule and initiates the cleaning operation determined in step 426. Therefore, if the nozzle threshold is exceeded for the nozzle group (step 418), the normal cleaning schedule is interrupted to perform an adapted cleaning operation.

Since the cleaning operation may be adapted to the type of nozzle defect and its defect/cleaning history, the control unit 240 may assign a cleaning operation having a different cleaning function, timing, and/or intensity/duration than that previously performed on the nozzle group. The timing may include the length of the suction or flushing sequence, or the amount of time before attempting to print again after a cleaning operation has been completed. For example, the control unit 240 may detect that a nozzle defect has reoccurred, and in response, increase the intensity and/or duration of the cleaning function as compared to the prior cleaning function performed on that nozzle. As another example, if a nozzle defect has reoccurred and the previous cleaning operation for that nozzle operated with a maximum intensity and/or duration, the control unit 240 may assign a different cleaning function and/or designate the nozzle as having a persistent defect.

In step 430, the control unit 240 updates the nozzle defect history 252 and the nozzle cleaning history 253 of the nozzle group. Therefore, nozzle defect information and cleaning history information may be continually tracked as defects are detected and cleanings are instructed and/or completed. The control unit 240 may analyze the tracked data collected over a period of time to determine cleaning parameters that most efficiently resolve nozzle defects. The steps of method 400 may repeat as desired for different nozzle groups of the printer 200. Accordingly, the method 400 provide a technical benefit in correcting nozzle defects with a minimal number of tailored cleaning operations.

Figure 5:
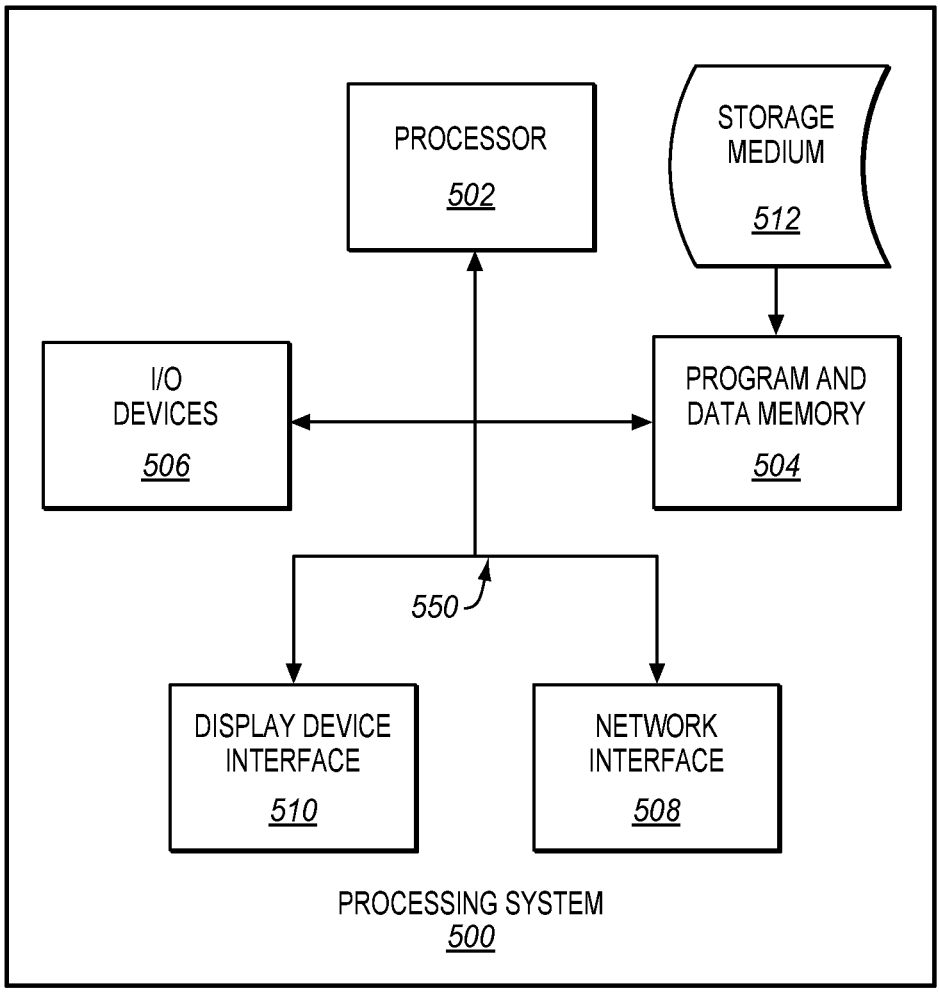
FIG. 5 illustrates a processing system operable to execute a computer readable medium embodying programmed instructions to perform desired functions in an illustrative embodiment.

Embodiments disclosed herein can take the form of software, hardware, firmware, or various combinations thereof. In one particular embodiment, software is used to direct a processing system of the maintenance system 210 to perform the various operations disclosed herein. FIG. 5 illustrates a processing system 500 operable to execute a computer readable medium embodying programmed instructions to perform desired functions in an illustrative embodiment. Processing system 500 is operable to perform the above operations by executing programmed instructions tangibly embodied on computer readable storage medium 512. In this regard, embodiments of the invention can take the form of a computer program accessible via computer-readable medium 512 providing program code for use by a computer or any other instruction execution system. For the purposes of this description, computer readable storage medium 512 can be anything that can contain or store the program for use by the computer.

Computer readable storage medium 512 can be an electronic, magnetic, optical, electromagnetic, infrared, or semiconductor device. Examples of computer readable storage medium 512 include a solid state memory, a magnetic tape, a removable computer diskette, a random access memory (RAM), a read-only memory (ROM), a rigid magnetic disk, and an optical disk. Current examples of optical disks include compact disk-read only memory (CD-ROM), compact disk-read/write (CD-R/W), and DVD.

Processing system 500, being suitable for storing and/or executing the program code, includes at least one processor 502 coupled to program and data memory 504 through a system bus 550. Program and data memory 504 can include local memory employed during actual execution of the program code, bulk storage, and cache memories that provide temporary storage of at least some program code and/or data in order to reduce the number of times the code and/or data are retrieved from bulk storage during execution.

Input/output or I/O devices 506 (including but not limited to keyboards, displays, pointing devices, etc.) can be coupled either directly or through intervening I/O controllers. Network adapter interfaces 508 may also be integrated with the system to enable processing system 500 to become coupled to other data processing systems or storage devices through intervening private or public networks. Modems, cable modems, IBM Channel attachments, SCSI, Fibre Channel, and Ethernet cards are just a few of the currently available types of network or host interface adapters. Display device interface 510 may be integrated with the system to interface to one or more display devices, such as printing systems and screens for presentation of data generated by processor 502.

Although specific embodiments were described herein, the scope of the invention is not limited to those specific embodiments. The scope of the invention is defined by the following claims and any equivalents thereof.

What is claimed is:

1. A system comprising:

a printer maintenance system comprising:

memory configured to store defect information of a group of nozzles of a printer; and a processor configured to calculate a threshold number of nozzle defects that triggers a cleaning operation based on an acceptable print quality level input by a user, and to determine whether the group of nozzles have a number of nozzle defects that exceeds the threshold number of nozzle defects based on the defect information, the processor further configured, in response to a determination that the threshold number of nozzle defects is exceeded, to determine a type of cleaning operation, a cleaning duration, and a cleaning intensity to perform for the group of nozzles based on the defect information, the processor further configured to initiate the cleaning operation for the group of nozzles according to the type of cleaning operation, the cleaning duration, and the cleaning intensity determined for the group of nozzles.

2. The system of claim 1 wherein:

the processor is further configured to track, in the memory, a nozzle defect history and a nozzle cleaning history for the group of nozzles, to determine whether the nozzle defects of the group of nozzles are persistent based on the nozzle defect history and the nozzle cleaning history, and to exempt the nozzle group from cleaning operations if a number of persistent defects in the nozzle group exceeds another threshold.

3. The system of claim 2 wherein:

the processor is further configured to determine that the nozzle defects are persistent based on a number of previous cleaning operations that failed to correct a particular nozzle.

4. The system of claim 2 wherein:

the processor is further configured to exclude the persistent defects from the number of nozzle defects in determining whether the group of nozzles have a number of nozzle defects that exceeds the threshold number of nozzle defects.

5. The system of claim 1 wherein:

the processor is further configured to determine a defect type of each of the nozzle defects, and to determine the type of cleaning operation, the cleaning duration, and the cleaning intensity to perform for the group of nozzles based on the defect type of each of the nozzle defects.

6. The system of claim 1 wherein:

the processor is further configured to identify a cleaning schedule for the group of nozzles, the processor is further configured, in response to determining that the threshold number of nozzle defects for the group of nozzles is not exceeded, to maintain the cleaning schedule for the group of nozzles, and the processor is further configured, in response to determining that the threshold number of nozzle defects for the group of nozzles is exceeded, to modify the cleaning schedule of the group of nozzles to change one or more of the cleaning type, the cleaning intensity, the cleaning duration for the group of nozzles, and a post-cleaning wait time for the group of nozzles.

7. The system of claim 1 further comprising:

a printer comprising:

a print engine including printheads each having a plurality of nozzles configured to eject ink; and one or more cleaning systems each configured to perform a cleaning function on the printheads of a printer, each cleaning function including multiple cleaning intensities and multiple cleaning durations.

8. A method of determining a category of cleaning to perform on nozzles of a printer, the method comprising:

receiving defect information of a group of nozzles of the printer;

calculating a threshold number of nozzle defects that triggers a cleaning operation based on an acceptable print quality level input by a user;

determining whether the group of nozzles have a number of nozzle defects that exceeds the threshold number of nozzle defects based on the defect information;

in response to determining the threshold number of nozzle defects is exceeded, determining a type of cleaning operation, a cleaning duration, and a cleaning intensity to perform for the group of nozzles based on the defect information; and initiating the cleaning operation for the group of nozzles according to the type of cleaning operation, the cleaning duration, and the cleaning intensity determined for the group of nozzles.

9. The method of claim 8 further comprising:

tracking, in memory, a nozzle defect history and a nozzle cleaning history for the group of nozzles;

determining whether the nozzle defects of the group of nozzles are persistent based on the nozzle defect history and the nozzle cleaning history; and exempting the nozzle group from cleaning operations if a number of persistent defects in the nozzle group exceeds another threshold.

10. The method of claim 9 further comprising:

determining that the nozzle defects are persistent based on a number of previous cleaning operations that failed to correct a particular nozzle defect.

11. The method of claim 9 wherein determining whether the group of nozzles have a number of nozzle defects that exceeds the threshold number of nozzle defects comprises:

excluding the persistent defects from the number of nozzle defects.

12. The method of claim 8 further comprising:

determining a defect type of each of the nozzle defects; and determining the type of cleaning operation, the cleaning duration, and the cleaning intensity to perform for the group of nozzles based on the defect type of each of the nozzle defects.

13. The method of claim 8 further comprising:

identifying a cleaning schedule for the group of nozzles;

in response to determining that the threshold number of nozzle defects for the group of nozzles is not exceeded, maintaining the cleaning schedule for the group of nozzles; and in response to determining that the threshold number of nozzle defects for the group of nozzles is exceeded, modifying the cleaning schedule of the group of nozzles to change one or more of the cleaning type, the cleaning intensity, the cleaning duration, and a post-cleaning wait time for the group of nozzles.

14. A tangible computer readable medium including programmed instructions which, when executed by a processor, are operable for performing a method, the method comprising:

receiving defect information of a group of nozzles of a printer;

calculating a threshold number of nozzle defects that triggers a cleaning operation based on an acceptable print quality level input by a user;

determining whether the group of nozzles have a number of nozzle defects that exceeds the threshold number of nozzle defects based on the defect information;

in response to determining the threshold number of nozzle defects is exceeded, determining a type of cleaning operation, a cleaning duration, and a cleaning intensity to perform for the group of nozzles based on the defect information; and initiating the cleaning operation for the group of nozzles according to the type of cleaning operation, the cleaning duration, and the cleaning intensity determined for the group of nozzles.

15. The medium of claim 14 wherein the method further comprises:

tracking, in memory, a nozzle defect history and a nozzle cleaning history for the group of nozzles;

determining whether the nozzle defects of the group of nozzles are persistent based on the nozzle defect history and the nozzle cleaning history; and exempting the nozzle group from cleaning operations if a number of persistent defects in the nozzle group exceeds another threshold.

16. The medium of claim 15 wherein the method further comprises:

determining that the nozzle defects are persistent based on a number of previous cleaning operations that failed to correct a particular nozzle defect.

17. The medium of claim 15 wherein determining whether the group of nozzles have a number of nozzle defects that exceeds the threshold number of nozzle defects comprises:

excluding the persistent defects from the number of nozzle defects.

18. The medium of claim 14 wherein the method further comprises:

determining a defect type of each of the nozzle defects; and determining the type of cleaning operation, the cleaning duration, and the cleaning intensity to perform for the group of nozzles based on the defect type of each of the nozzle defects.

19. The medium of claim 14 wherein the method further comprises:

identifying a cleaning schedule for the group of nozzles;

in response to determining that the threshold number of nozzle defects for the group of nozzles is not exceeded, maintaining the cleaning schedule for the group of nozzles; and in response to determining that the threshold number of nozzle defects for the group of nozzles is exceeded, modifying the cleaning schedule of the group of nozzles to change one or more of the cleaning type, the cleaning intensity, the cleaning duration, and a post-cleaning wait time for the group of nozzles.

20. The medium of claim 14 wherein the method further comprises:

obtaining image data of a test chart printed on a web by the group of nozzles;

analyzing the image data of the test chart to identify one or more nozzle defects; and determining whether the threshold number of nozzle defects for the group of nozzles is exceeded as a result of the one or more nozzle defects detected in the test chart.

* * * * *